US006250121B1

(12) United States Patent
Kobayashi et al.

(10) Patent No.: US 6,250,121 B1
(45) Date of Patent: Jun. 26, 2001

(54) METHOD FOR MOLDING METAL USING HIGH FLUID PRESSURE

(75) Inventors: Kazuto Kobayashi; Hisanobu Kanamaru, both of Sagamihara; Akira Matsumura, Atsugi, all of (JP)

(73) Assignee: Aida Engineering Co., Ltd. (JP)

( * ) Notice: Subject to any disclaimer, the term of this patent is extended or adjusted under 35 U.S.C. 154(b) by 0 days.

(21) Appl. No.: 09/545,082

(22) Filed: Apr. 7, 2000

(30) Foreign Application Priority Data

Apr. 9, 1999 (JP) ..... 11-102448

(51) Int. Cl.[7] ..... B21D 26/02
(52) U.S. Cl. ..... 72/58; 72/60; 72/61
(58) Field of Search ..... 72/58, 60, 61

(56) References Cited

U.S. PATENT DOCUMENTS 1,766,098 * 6/1930 Booth ..... 72/58
2,592,867 * 4/1952 Cuq ..... 72/58
2,688,297 * 9/1954 Livermont et al. ..... 72/58
2,767,765 * 10/1956 Cartwright ..... 72/58
3,335,590 * 8/1967 Early ..... 72/58
3,611,768 * 10/1971 Odagaki ..... 72/58
4,265,102 * 5/1981 Shimakata et al. ..... 72/58
4,590,655 * 5/1986 Javorik ..... 75/58
5,022,135 * 6/1991 Miller et al. ..... 72/58

* cited by examiner

*Primary Examiner*—David Jones
(74) *Attorney, Agent, or Firm*—Morrison Law Firm

(57) ABSTRACT

A molding method uses a fluid-pressure generating unit form generating high fluid pressures that allows high-precision molding of complex shapes. The high fluid pressure is generated with a piston disposed in communication with a molding cavity. The high fluid pressure is imposed on a raw material workpiece to push the workpiece into a cavity causing the workpiece to conform to the shape of the cavity thereby producing an article of desired shape.

8 Claims, 7 Drawing Sheets

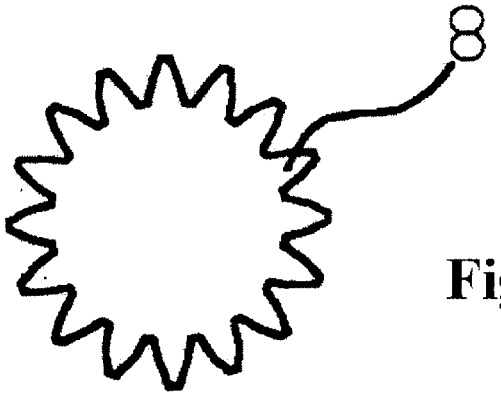
Fig. 6
Fig. 7a
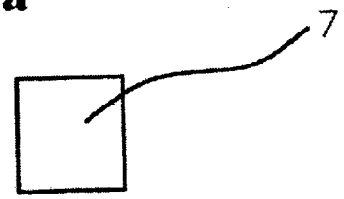
Fig. 7b
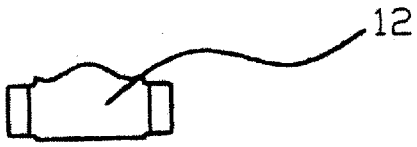
Fig. 8a
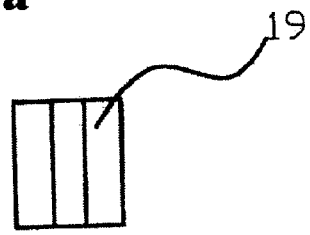
Fig. 8b
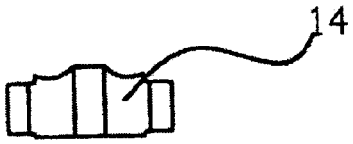

METHOD FOR MOLDING METAL USING HIGH FLUID PRESSURE

BACKGROUND OF THE INVENTION

The present invention relates to a method for molding metals using high fluid pressure. As used herein, "fluid pressure" can include that of oil pressure, water pressure, or the like. "Method for molding" is used to indicate that fluid pressure is applied to a raw material to perform a molding of same into article shape.

Conventionally, articles having complex shapes including gears and the like have been molded using a female/male mold unit, i.e., a die and an punch. An example of this is described in Japanese laid-open patent publication number 5-154598.

In Japanese laid-open patent publication number 5-154598, a metal raw material is placed in a die. A punch is used to perform molding. In the molding operation, the punch and the metal raw material come into contact under high pressure so that resistance is generated between the two. This resulted in the fluidity of the metal material not always being adequately matched with the shape of the cavity.

This problem is not restricted to the molding operation disclosed in Japanese laid-open patent publication number 5-154598. It applies to all similar types of molding that use a die and a punch.

Japanese laid-open patent publication number 10-175028 and Japanese laid-open patent publication number 10-296347 are examples of conventional technology in which molding is performed using fluid pressure. In the former, a hydroform method involves a metal pipe, e.g., a copper pipe, placed in a split mold. An internal pressure, applied to the pipe, in the direction of the axis of the pipe, molds the pipe into a predetermined shape to form an article in the form of a bellows-pipe. In the latter publication, a fluid-pressure bulge processing method is presented. Internal pressure from fluid in a metal pipe is combined with axial compression of the metal pipe in order to expand a section of the metal pipe.

In both of these technologies, hollow piton-shaped members are disposed on either side of the metal pipe, which serves as the raw material. The piston-shaped members feed pressurized oil to the inner diameter of the metal pipe and push the metal pipe from both ends. These piston-shaped members are inserted into holes disposed in a split mold. The hollow section of the piston-shaped member serves as an oil passage through which the pressurized oil is fed. A sealing member is generally mounted to the outer diameter section of the piston-shaped member to prevent the fluid from leaking.

Due to its purpose, the sealing member must be flexible, so its resistance to pressure is limited. For example, such a sealing member generally cannot withstand a fluid pressure of approximately 2000 Mpa. Thus, high-pressure molding, using this method has not been conventionally possible. In both of these technologies, a high degree of process ability is provided by using the piston-shaped members to press from both ends of the raw material.

SUMMARY OF THE INVENTION

An object of the present invention is to provided a molding method using a fluid-pressure generating unit capable of generating high pressures that allows high-precision molding of complex shapes that conventional methods could not produce.

A piston for generating high fluid pressure is disposed in the bore passage of a metal mold, the bore passage being in registry with an entry to a cavity in the metal mold so that a workpiece at least partly in the cavity can have a high fluid pressure, produced with the piston, imposed on it. This pressure imposed on the workpiece causes the raw metal material thereof to be pushed into the cavity and to assume in said cavity an article shape having an external configuration corresponding to an internal geometry of said cavity thereby forming an article of desired shape.

BRIEF DESCRIPTION OF THE DRAWINGS

FIG. 6 is a plan view showing of a representative horizontal geometry of the lower block cavity in the FIGS. 1–3 mold unit.

FIGS. 7*a* and 7*b* are respective elevation views of is a workpiece and the molded article made from said workpiece in accordance with the first embodiment of the invention.

FIGS. 8*a* and 8*b* are respective elevation views of the workpiece and molded article made therefrom by the second embodiment of the invention.

DESCRIPTION OF THE PREFERRED EMBODIMENTS

Figure 1A:
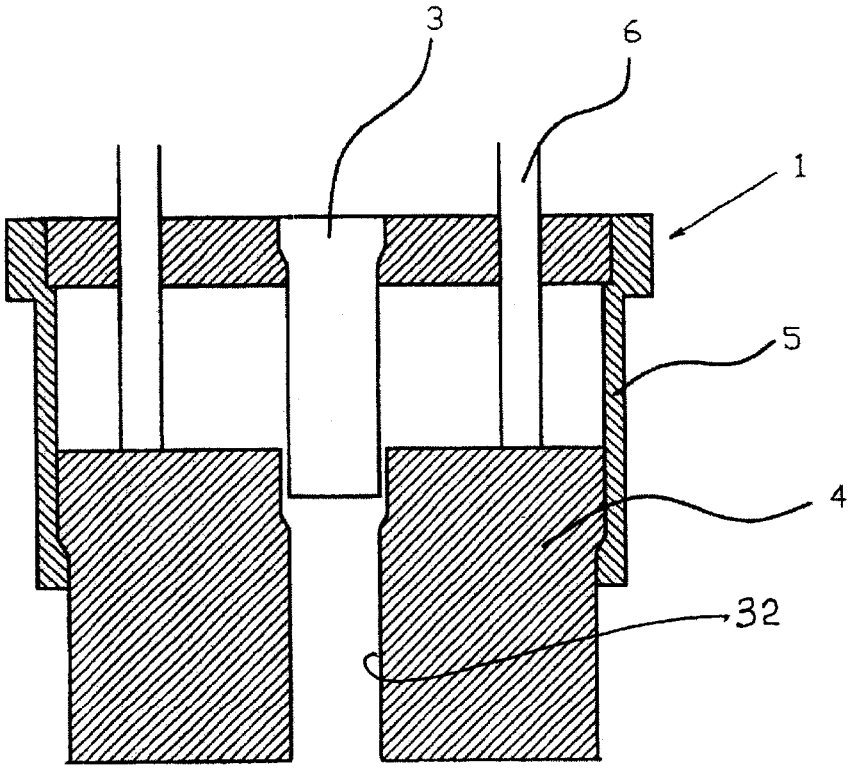
FIG. 1*a* is a vertical cross-sectional view of the upper mold part used in a first embodiment of the invention.
Figure 1B:
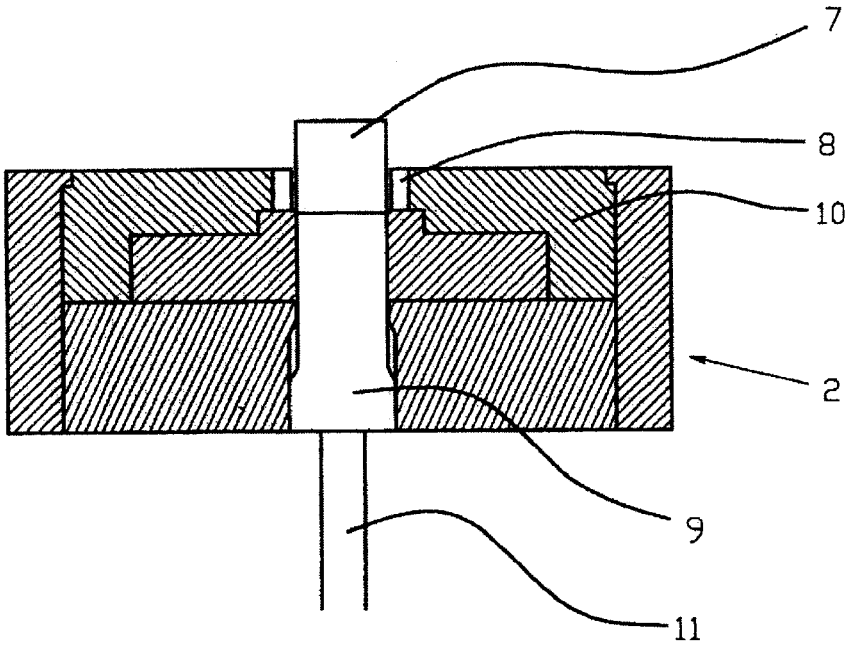
FIG. 1*b* is a vertical cross-section view of the lower mold part used with the FIG. 1*a* upper mold part, a workpiece being shown with at least a part thereof set in place in a forming cavity of the lower mold part.

Referring to FIGS. 1*a* and 1*b,* a first embodiment of the invention will be described for molding a solid workpiece to provide a solid molded article. In this embodiment, a solid workpiece is molded to provide a solid molded article. FIG. 1*a* shows an upper mold part 1 which is mounted on a slide of a press (not shown). FIG. 1 shows a lower mold 2 part that is mounted on a bolster of the press (not shown). The upper mold part 1 and the lower mold part 2 form a mold unit. A work piece 7 (FIG. 7*a*) is molded with this mold to form a molded article 12 (FIG. 7*b*).

A piston 3, an upper block 4, a guide 5, and pine 6 are disposed on the upper mold part 1. These members are raised and lowered in tandem with the slide of the press. This piston moves in a bore passage 32 in upper block 4. The upper block 4 is guided by the guide 5. The upper block 4 is actuated is driven by the pins 6 so that it can be raised and lowered freely.

A lower block 10, a counter-punch 9, and a knock-out pin 11 are disposed on the lower mold part 2. The counter punch 9 is mounted inside the lower block 10. The counter punch 9 actuated by the knock-out pin 11 so that it can be raised and lowered freely. As seen from FIG. 6, the lower block 10 is formed with a cavity 8 having a horizontal cross-section shape as depicted in that figure although other shapes could be used as desired.

Figure 2:
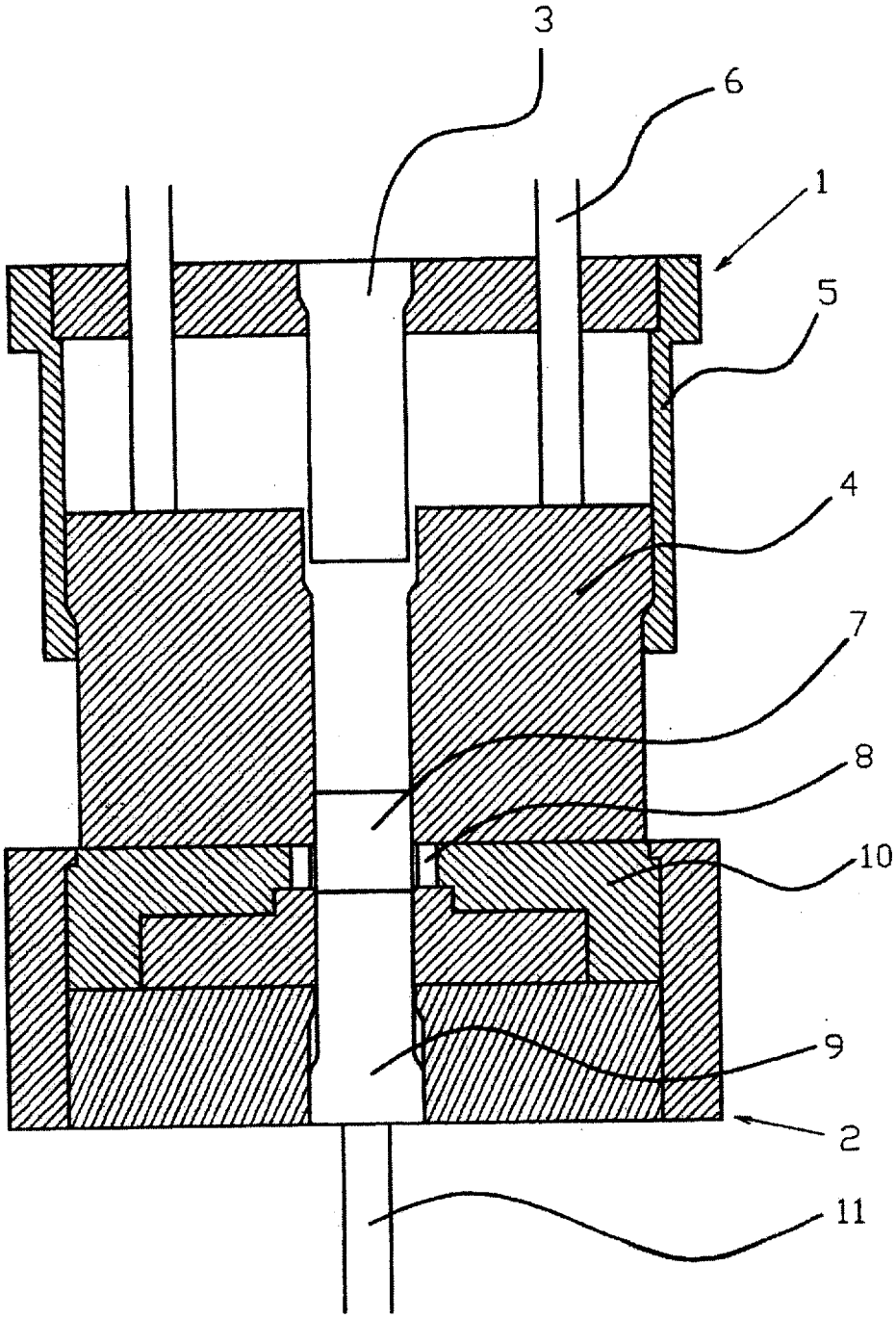
FIG. 2 is a vertical cross-section view wherein the upper and lower mold parts have been moved to bring an upper block in the upper mold part into contact with a lower block on the lower mold part.
Figure 3:
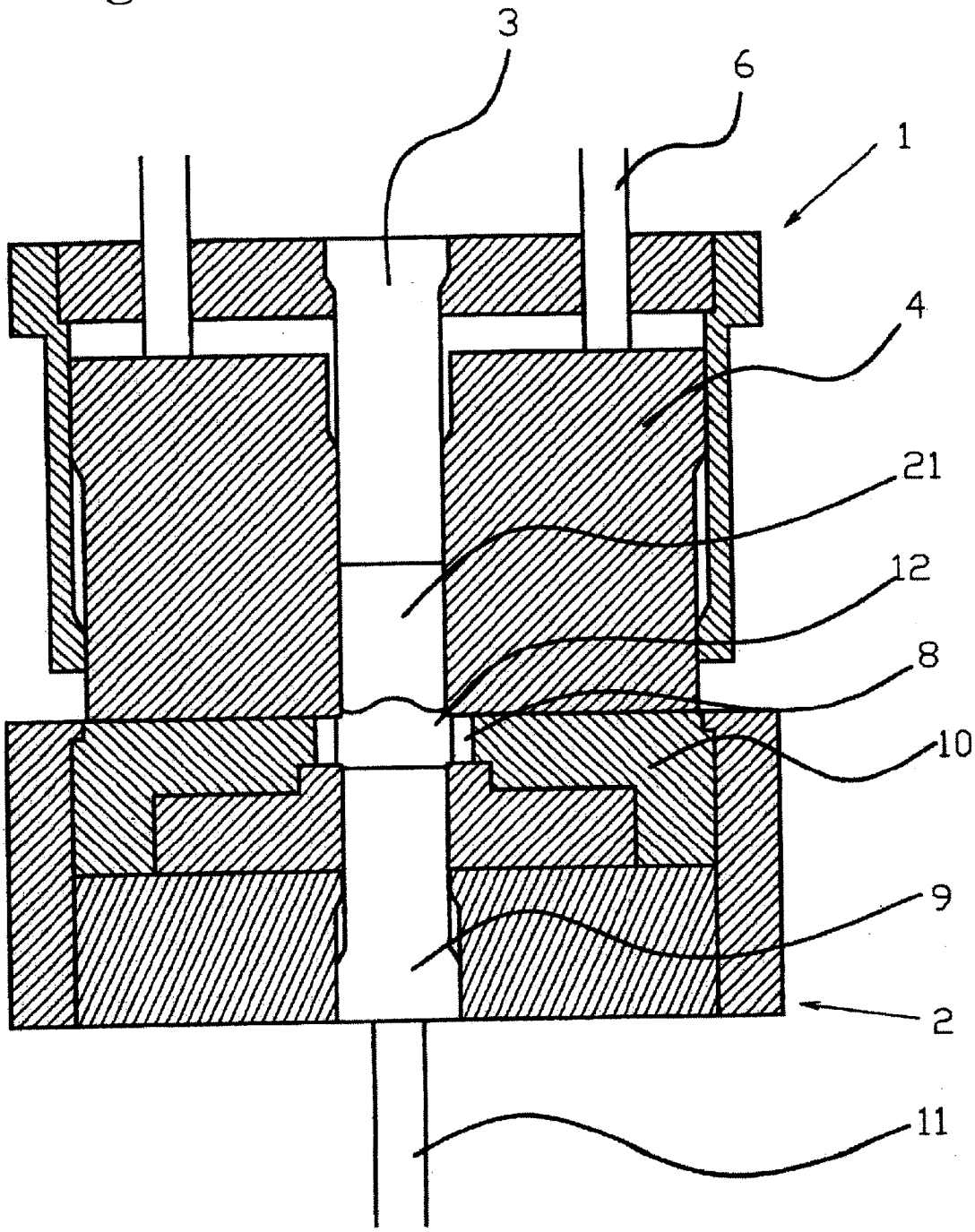
FIG. 3 is a vertical cross-section view similar to FIG. 2 showing a workpiece that has been formed by pressing the workpiece into the cavity formed in the lower block.

The workpiece 7 is set on the lower block 10 disposed at least partly in cavity 8. Referring to FIG. 2 and FIG. 3, molding is performed according to the sequence next described. With reference to FIG. 2, when the slide is lowered, the upper mold 1 part descends and the upper block 4 and the lower block 10 are pressed tightly against each other. The force to press together the upper block 4 and the lower block 10 comes from the pins 6. The outer dimensions of the workpiece 7 are set to prevent gaps from forming between the inner surface of the bore cavity 32 and the upper block 4 and the workpiece outer surface. A top portion of the workpiece 7 is located in bore passage 32 of the upper block 4. At this point, a fluid is fed into the space of bore passage 32 below piston 3. The fluid disposing above a top part of the workpiece 7 in contact therewith.

Referring to FIG. 3, as the piston 3 descends further the fluid will become compressed by the piston 3 to form a high fluid-pressure in chamber 21. The pressure is raised to at least not less than twice the deformation resistance of the workpiece raw material. The high fluid-pressure imposed on the workpiece causes the material of the workpiece to flow into cavity 8 and thereby to form the molded article 12. The high pressure causes the workpiece external surface to conform in shape to the internal geometry of the cavity. It is understood that the pressure forces the workpiece to fully fill cavity 8, leaving no voids.

Then, the slide is raised and the upper mold 1 part ascends. The molded article 12 left on the lower block 10 is pushed out from the lower block 10 by the counter-punch 9 and the knock-out pin 11.

Figure 4:
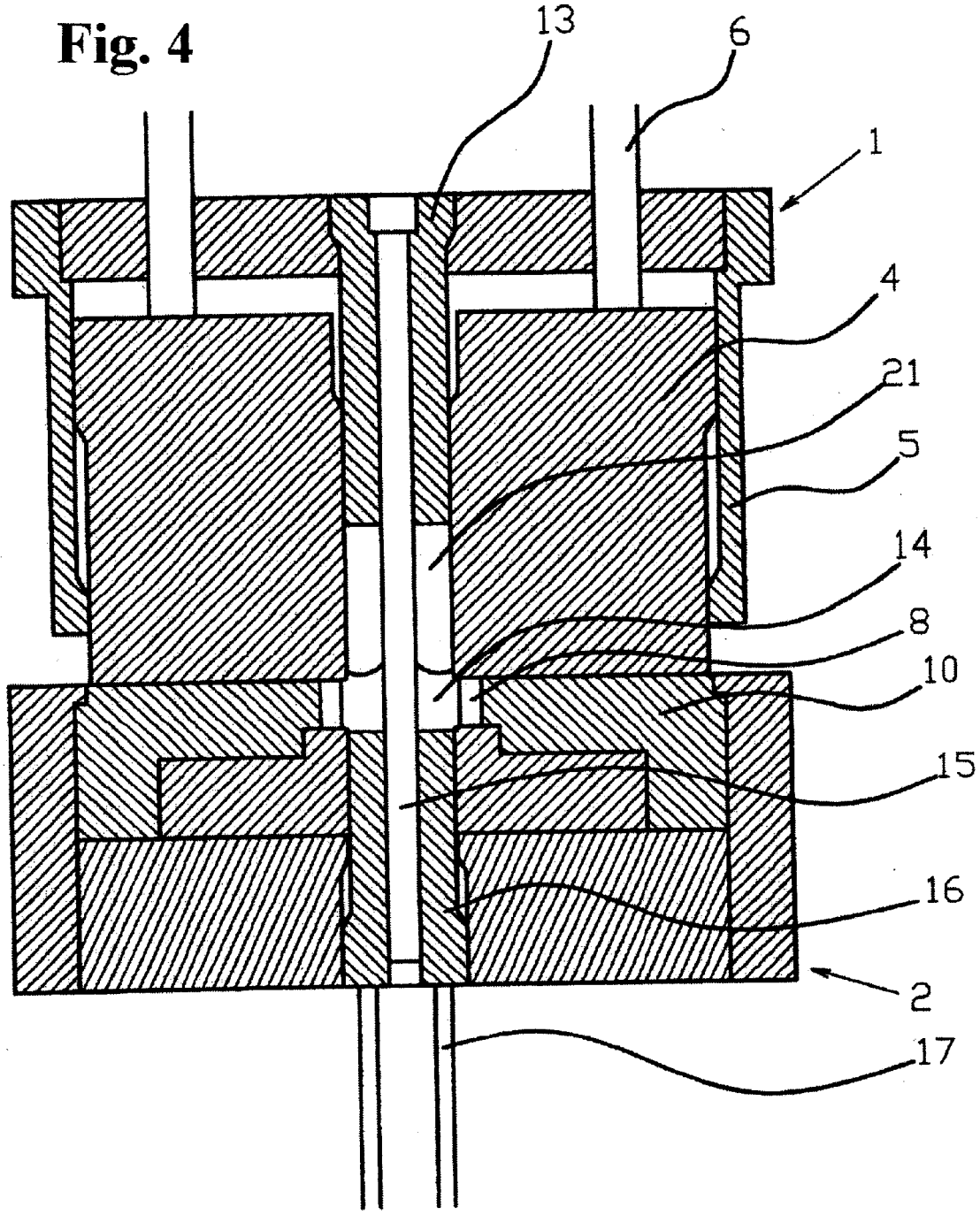
FIG. 4 is a vertical cross-section view depicting how a workpiece is made according to a second embodiment of the invention into a molded article having a hole therein.

Referring to FIG. 4, there is shown a second embodiment. This embodiment differs from the first embodiment in that a mandrel 15 is used to form a molded article 14 having a hole. Otherwise, the technique employed is identical to that used in the first embodiment.

Referring to FIG. 4, a piston 13, a mandrel 15, an upper block 4, a guide 5, and pins 6 are disposed on the upper mold 1. These members are raised and lowered in tandem with the slide of the press. The upper block 4 is guided by the guide 5 and is actuated by pins 6 so that it can be raised and lowered freely. The mandrel 15 is fixed to the piston 13.

The lower block 10 includes a counter-punch 16 with a hold and a plurality of knock-out pins 17 disposed on the lower mold part 2. The counter-punch 9 is mounted in the lower block 10. The counter-punch 9 is actuated by the knock-out pins 17 to allow it to be freely raised and lowered. The counter-punch 16 includes a hold therein to avoid interfering with the mandrel 15. The lower block 10 as noted earlier above is formed with the horizontal cross-section shape of FIG. 6.

A workpiece 19 (not shown in the figure) is set on the lower block 10. When the slide is lowered, the upper mold part 1 descends and the upper block 4 and the lower block 10 are pressed tightly together. The force pressing the upper block 4 and the lower block 10 tightly together is generated by the pins 6. The dimensions of the workpiece 19 are set to prevent a gap from forming between the inner surface of the opening of the upper block 4 and the outer surface of the workpiece 19 as well as between the outer surface of the mandrel 15 and the inner surface of the opening of the workpiece 19. The workpiece 19 is pressed into the cavity of the upper block 4 as the mandrel 15 is pushed into the hole of the workpiece 19. At this point, a fluid is fed into the space below the piston 3 formed between the upper block 4 and the mandrel 15.

As the piston 13 descends further, the fluid is compressed by the piston 13, the cavity in upper block becoming a high fluid-pressure chamber 32. The workpiece is caused to flow into the cavity 8 by this high fluid pressure, and the molded article 14 be formed.

The slide is then raised and the upper mold part 1 ascends. The molded article 14 left on the lower block 10 is pushed off of the lower block 10 by the counter-punch 16 and the knock-out pins 17.

Figure 5:
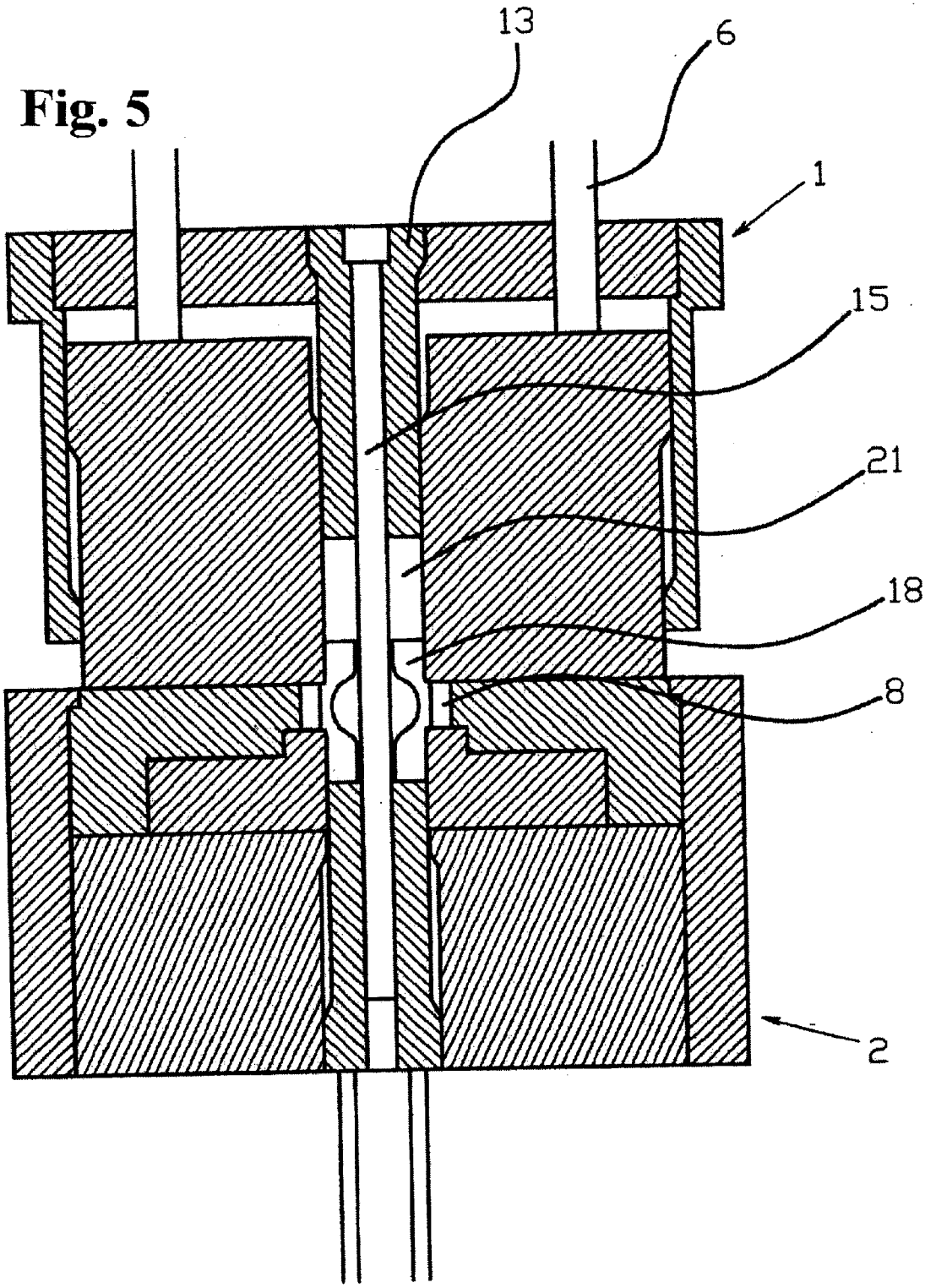
FIG. 5 is a vertical cross-section depicting making of a workpiece according to a third embodiment of the invention.
Figure 9A:
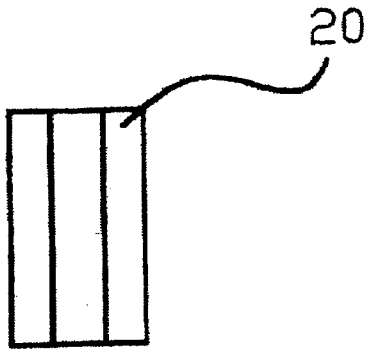
FIGS. 9*a* and 9*b* are the workpiece and the molded article made therefrom in accordance with a the third embodiment of the invention.
Figure 9B:
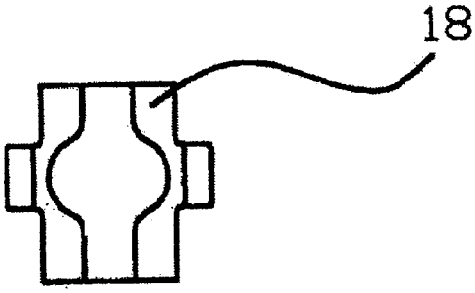

Referring to FIG. 5, a third embodiment of the of the invention is described. This embodiment differs from the second embodiment described above in that a gap is formed between a workpiece 20 (shown in FIG. 9*a*) and the mandrel 15. Other aspects of the structures are the same in FIGS. 1–4.

Referring to FIG. 5, a gap is present between the workpiece 20 and the mandrel 15, and in this embodiment the gap causes the fluid from the high fluid-pressure chamber 21 to invest the hole in the workpiece as well. Thus, the workpiece material defining the hole expands, resulting in the formation of a molded article 18 having a widened central hole therein, as shown in FIG. 5.

Referring to FIGS. 7*a* and 7*b*, FIGS. 8*a* and 8*b*, and FIGS. 9*a* and 9*b*, there is shown the relationship between the raw material workpieces and the formed molded articles made in the respective ones of the first, second, and third embodiments of the invention.

In the present invention, there is no direct contact between a metal raw material and a punch. Thus, the flow of the metal raw material is not obstructed by resistance generated by the friction between the two. This makes it possible to provide articles with complex shapes. Furthermore, since pressure at least twice the deformation resistance of the metal raw material can be used, articles with complex shapes and requiring high precision can be provided.

What is claimed is:

1. A method for molding a metal article using high fluid pressure comprising the steps of:

positioning a metal workpiece at least partly in a molding cavity in a lower block of a metal mold;

lowering an upper block over said workpiece without contacting said workpiece;

said upper block sealing with said lower block to form a high-pressure space over said workpiece;

adding a fluid substantially filling said high-pressure space;

generating a high fluid pressure in said high-pressure space; and said high fluid pressure being sufficiently higher than a yield strength of a material of said workpiece to deform said workpiece into said molding cavity where it assumes an article shape having an external configuration corresponding to a geometry of said cavity.

2. A method for molding a metal article using high fluid pressure in accordance with claim 1 in which said high fluid pressure is generated by activating a piston disposed in a bore passage of said metal mold, the fluid being pressurized intervening the piston and the workpiece, the bore passage registering with an entry to said molding cavity.

3. A method for molding a metal article using high fluid pressure in accordance with claim 1 in which said high fluid pressure at least twice a deformation resistance of said metal raw material.

4. A method according to claim 1, wherein:

the step of adding a fluid includes filling a bore passage in fluid communication with said high-pressure space; and the step of lowering includes a first step of lowering said upper block into sealing arrangement with said lower block, and then, after the step of filling, forcing a piston into said bore to generate said high fluid pressure.

5. A method for molding a metal article using high fluid pressure comprising the steps of:

positioning a metal workpiece having a through hold therein at least partly in a molding cavity of a lower block of a metal mold, said metal mold having a mandrel located therein, the mandrel passing through a hold in the workpiece;

lowering an upper block over said workpiece without contacting said workpiece;

said upper block sealing with said lower block to form a high-pressure space over said workpiece;

adding a fluid substantially filling said high-pressure space;

generating a high fluid pressure in said high-pressure space; and said high fluid pressure being sufficiently higher than a yield strength of a material of said workpiece to deform said workpiece into said molding cavity where it assumes an article shape having an external configuration corresponding to a geometry of said cavity.

6. A method for molding a metal article using high fluid pressure in accordance with claim 5 in which said high pressure fluid is generated by activating a piston disposed in a bore passage of said metal mold, the mandrel passing through said piston, the fluid being pressurized intervening the piston and the workpiece, the bore passage registering with an entry to said mold cavity.

7. A method for molding a metal article using high fluid pressure in accordance with claim 5 further comprising:

forming a gap between the hold in said workpiece and said mandrel passing therethrough so that high fluid pressure acts on the workpiece structure defining said hold to expand said workpiece into said gap to form a widened central space in the article.

8. A method according to claim 5, wherein:

the step of adding a fluid includes filling a bore passage in fluid communication with said high-pressure space; and the step of lowering includes a first step of lowering said upper block into sealing arrangement with said lower block, and then, after the step of filling, forcing a piston into said bore to generate said high fluid pressure.

* * * * *